US007381113B2

(12) United States Patent
Hori

(10) Patent No.: US 7,381,113 B2
(45) Date of Patent: Jun. 3, 2008

(54) FIGURE-ENHANCING SPORTS BRA

(76) Inventor: Miyuki Hori, 4-8-7 Shiroganedai, Minato-ku, Storia Shirogane II #1403, Tokyo (JP)

( * ) Notice: Subject to any disclaimer, the term of this patent is extended or adjusted under 35 U.S.C. 154(b) by 0 days.

(21) Appl. No.: 11/470,745

(22) Filed: Sep. 7, 2006

(65) Prior Publication Data

US 2008/0003922 A1 Jan. 3, 2008

Related U.S. Application Data

(60) Provisional application No. 60/811,517, filed on Jun. 7, 2006.

(51) Int. Cl.
*A41C 3/10* (2006.01)
*A41C 3/12* (2006.01)

(52) U.S. Cl. ..... 450/55; 450/57

(58) Field of Classification Search ..... 450/1, 450/39, 54–57, 38; 2/267, 268
See application file for complete search history.

(56) References Cited

U.S. PATENT DOCUMENTS 2,817,842 A * 12/1957 Block et al. ..... 450/54
4,289,137 A 9/1981 Dell et al.
4,583,544 A 4/1986 Flanagan et al.
4,741,719 A 5/1988 Wirth
5,334,082 A * 8/1994 Barker ..... 450/31
5,823,851 A 10/1998 Dicker
5,946,726 A 9/1999 Green
6,083,080 A * 7/2000 Lawson et al. ..... 450/39
6,110,005 A * 8/2000 Stephenson et al. ..... 450/39
6,116,985 A 9/2000 Lambert
6,165,045 A 12/2000 Miller et al.
6,180,178 B1 1/2001 Vogt
6,431,945 B1 * 8/2002 Stephens et al. ..... 450/37
6,811,463 B2 11/2004 Martz
6,811,464 B2 * 11/2004 Li ..... 450/57
6,988,931 B1 1/2006 Martinet et al.

* cited by examiner

*Primary Examiner*—Gloria M. Hale
(74) *Attorney, Agent, or Firm*—Woodard, Emhardt, Moriarty, McNett & Henry LLP

(57) ABSTRACT

An exercise brassiere provides sufficient support to allow a wearer to participate in active exercise or sporting events, yet is constructed to improve the esthetic appearance of the wearer's breasts. Support structure located between fabric layers firmly restricts undesirable movement of the wearer's breasts during exercise or sports activities that could otherwise cause damage to the breast tissue. The support structure also is made to enhance the figure of the wearer so as to improve the overall appearance of the wearer's bust line.

13 Claims, 2 Drawing Sheets

FIGURE-ENHANCING SPORTS BRA

REFERENCE TO RELATED APPLICATION

This application claims priority from a Provisional Application Ser. No. 60/811,517, filed Jun. 7, 2006, which is hereby incorporated by reference.

BACKGROUND

Many women use sports or exercise bras to provide breast support and to reduce breast movement during physical activity in order to prevent damage to breast tissue. These bras are typically manufactured of an elastic or other stretchable material that tightly holds and contains the breasts. These bras therefore tend to push down the breasts, making them appear smaller than their normal size. Women having small breasts may become self-conscious and be reluctant to purchase or wear a sports bra for fear of appearing to have an even smaller bust.

SUMMARY

It is therefore an object of this disclosure to describe a figure-enhancing sports or exercise bra that provides a level of support necessary to participate in exercise or active sports while improving the aesthetic appearance of the wearer's breasts.

It is another object of this disclosure to describe a sports or exercise bra that maintains a smooth and natural appearance over the life of the garment.

It is yet another object of this disclosure to describe a sports or exercise bra that prevents damage to breast tissue during participation in exercise or sports.

These and other objects will become apparent from the illustrated drawing and the description of the embodiments.

DESCRIPTION OF THE EMBODIMENTS

Figure 1:
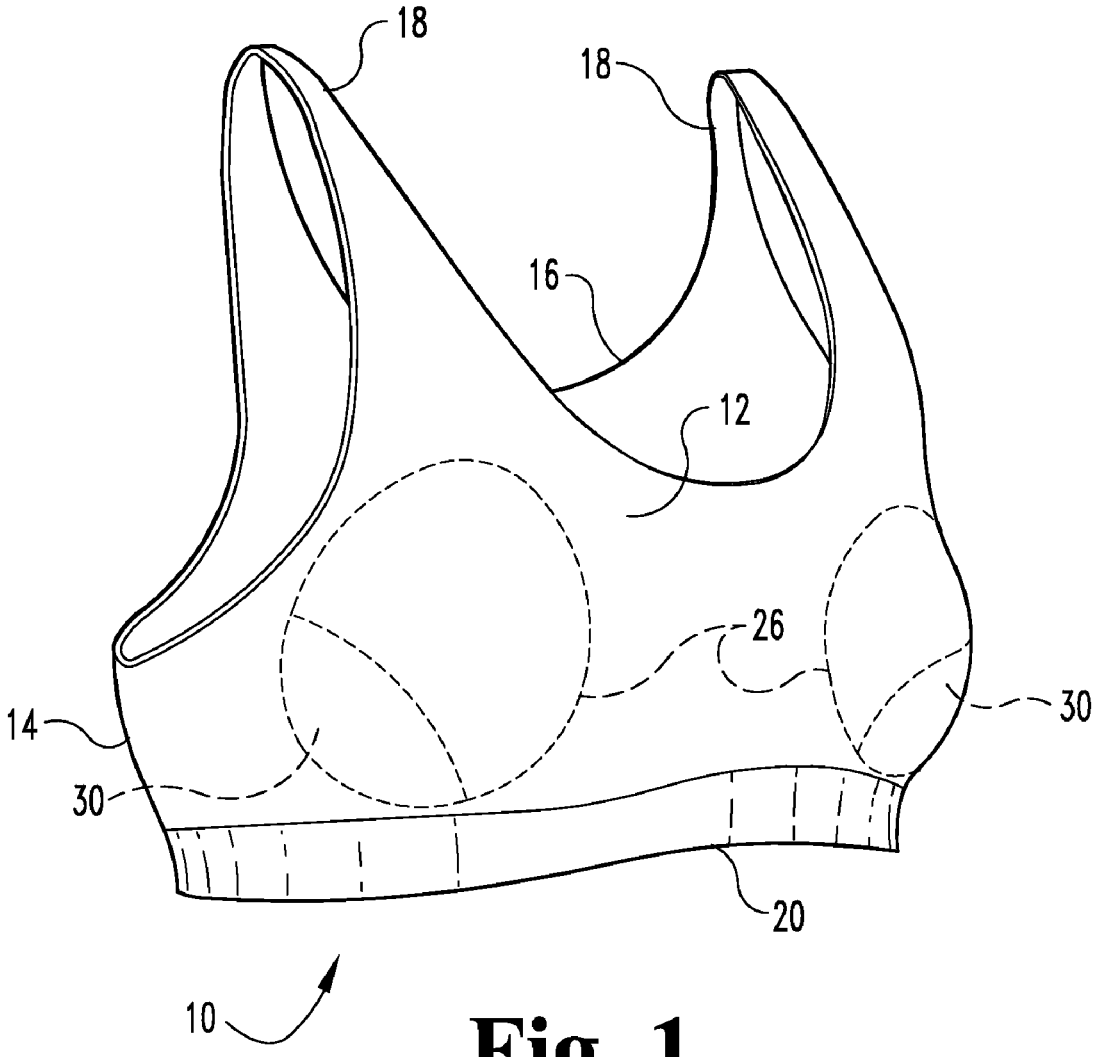
FIG. 1 is a perspective view of an exercise brassiere constructed in accordance with an aspect of this disclosure.

Referring to FIG. 1, there is illustratively shown a sports or exercise brassiere ("bra") 10 having a front 12, sides 14, back 16, and straps 18. Other designs, e.g., strap configurations or neckline, are also possible and will be equally applicable with respect to the subject matter of this disclosure. Sports bra 10 also incorporates a band 20 which extends around the bottom edges of front 12, sides 14, and back 16. Band 20 is made of an elastic material such that sports bra 10 fits snugly but is not uncomfortably tight.

Sports bra 10 is illustratively constructed with an outer fabric layer 22 of elastic or stretchable fabric, such as spandex, nylon or polyester, as a few non-limiting examples, preferably without, or with a minimum of, seams, so as to improve the appearance of sports bra 10. Outer fabric layer 22 illustratively encompasses front 12, sides 14, back 16, straps 18, and band 20. Outer fabric layer 22 may comprise one or more colors or designs, including brand or team logos or trademarks.

Sports bra 10 is also illustratively constructed with an inner fabric layer 24 that may be of a material similar to that of outer fabric layer 22, or be of a material that is chosen to provide optimal comfort, e.g., softness or perspiration absorbency, when positioned against the skin of a wearer. Inner fabric layer 24 encompasses at least front 12, and may encompass one or more of sides 14, back 16, straps 18, and band 20.

Figure 2:
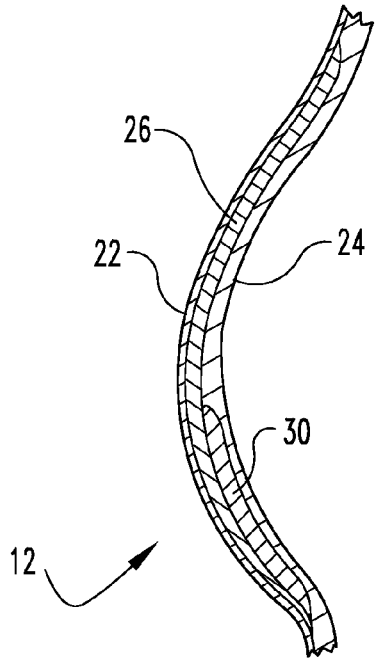
FIG. 2 is an side elevational cross-sectional view of a portion of the exercise brassiere shown in FIG. 1.

In accordance with an aspect of the disclosure, and as illustratively shown in FIGS. 1 and 2, sports bra 10 incorporates breast cups 26 (shown in phantom in FIG. 1) located between inner fabric layer 24 and outer fabric layer 22 within front 12. Breast cups 26 are discrete from inner fabric layer 24 and outer fabric layer 22. Optionally, breast cups 26 may be secured to either or both of inner fabric layer 24 and/or outer fabric layer 22, as discussed in greater detail below. Breast cups 26 are preferably made of a flexible material that is capable of conforming to the surface of a wearer's breasts while securely retaining the breasts as well as restraining the breasts from excessive or undesirable movement that could otherwise damage the skin or tissue around or associated with the wearer's breasts. Breast cups 26 each comprise a breast pad 30 (also shown in phantom in FIG. 1), which are located and positioned within the lower and outer side quadrants or areas of breast cups 26. The positioning of breast pads 30 corresponds to the lower and outer side quadrant areas of the wearer's breasts, in other words, towards the sides of the wearer's body on the breasts and towards the lower areas of the breasts. Breast pads 30 are illustratively shown to be generally oval-shaped, although other shapes are of course possible, and are designed to enhance the physical appearance of the wearer of sports bra 10, i.e., push up breasts, give breasts a rounder shape, and make the breasts appear larger. It is noted that breast cups 26, along with breast pads 30, are disposed, such as by lamination as only one example, between the inner and outer fabric layers 24 and 22, respectively, with the result that breast cups 26, as well as breast pads 30, are not visible to anyone observing sports bra 10 being worn, thereby giving front 12 of sports bra 10 a smooth and natural appearance.

Breast pads 30 may be made of any desired thickness, e.g., between 0.2 cm and 1.2 cm, for example, to feel comfortable, appear natural, and provide sufficient breast support. The thickness of breast pads 30 will also determine the degree of breast enhancement provided by sports bra 10, and sports bras may be made available with different breast pad thicknesses, depending upon the wearer's normal breast size and the amount of enhancement that is desired. Breast pads 30 may be constructed of a variety of materials, including but not limited to, cloth, foam, sponge rubber, silicone or other gel-like material, or any combination of such materials. By fixing the position of breast cups 26 between the outer and inner fabric layers 22 and 24, with breast pads 30 fixed to breast cups 26, such as by adhesive or by sewing, for example, breast cups 26 and breast pads 30 will remain securely in place and will therefore also maintain the wearer's breasts in place while allowing only a limited amount of movement of the breasts such that damage to the wearer's breasts or breast tissue due to excessive motion is significantly reduced or eliminated. Securing breast cups 26 and breast pads 30 between outer and inner fabric layers 22 and 24 also allows the thickness, shape and contour of breast pads 30 to be accurately controlled, thereby reducing or eliminating bulkiness or the tendency toward bunching that may result in sports bras that have removable breast pads. Additionally, by fixing the position of breast cups 26 and breast pads 30 between outer fabric layer 22 and inner fabric layer 24, the smooth natural look of front 12 of sports bra 10 will therefore be maintained throughout the garment life of sports bra 10.

Figure 3:
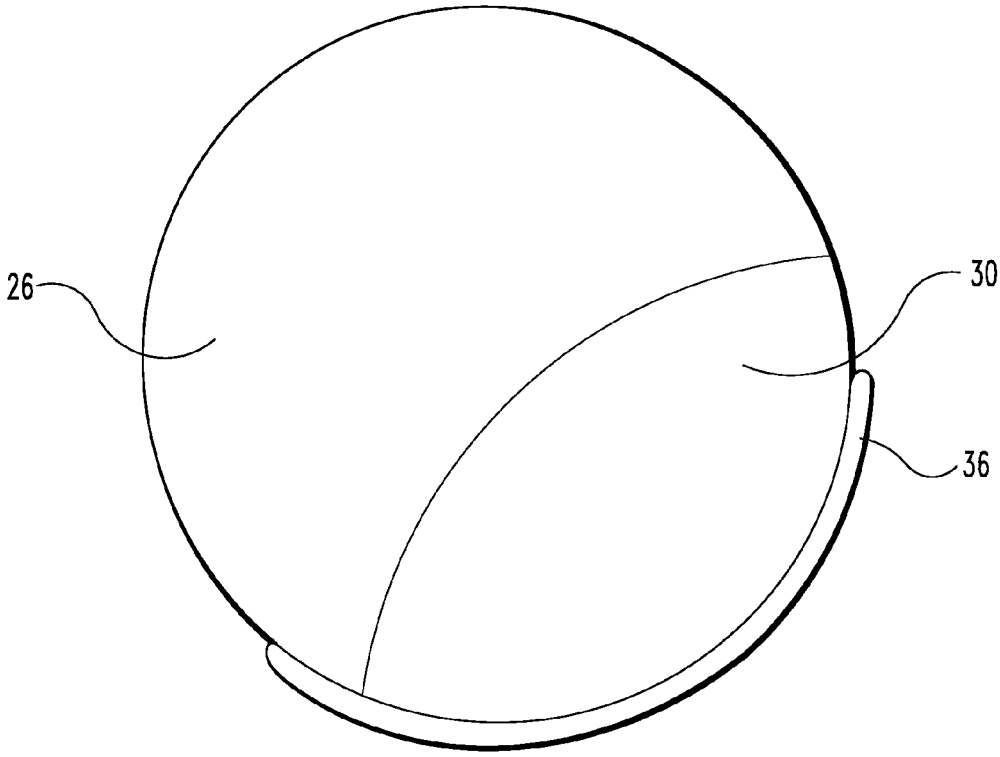
FIG. 3 is a rear elevational view of an embodiment of one element of the exercise brassiere shown in FIGS. 1 and 2.

Band 20 is designed to have a width of the order of 3 cm or more to provide strong under-bust support and to limit transverse movement of breast cups 26 and breast pads 30 so as to maintain the breasts of a wearer in a comfortable and supported position for extended periods of time. The width and elasticity of band 20 is chosen to ensure that sports bra 10 maintains a proper fit on the wearer and does not appreciably move or shift position during exercise or other activity. Band 20 therefore performs the function of an underwire which cooperates with breast cups 26 and the position of breast pads 30 within breast cups 26 (i.e., within the lower-outer breast quadrant) to create upward and inward pressure to push the wearer's breasts upwardly and inwardly, thereby increasing cleavage and making the breasts appear larger. Additional breast support, such as underwire 36, shown in FIG. 3, may also be provided below each breast pad 30 to further support the breasts in a figure-enhancing position as desired.

Sides 14 of sports bra 10 are constructed to have a width of the order of 11 cm or more in order to also provide additional side breast support that aids in maintaining the breasts in proper position. The neck contour of front 12, e.g., V-neck or U-neck, for example, is designed to provide an opening or gap when sports bra 10 is worn in order to show the cleavage of the wearer's breasts. In one embodiment, this gap is of the order of 2.5 cm or more.

Sports bra 10 therefore provides excellent breast support and motion control to prevent breast tissue damage during exercise or participation in sports activities, while additionally enhancing the aesthetic appearance of the wearer's bust line, thereby making a smaller-busted woman feel more attractive and less self conscious about exercising in public.

What is claimed is:

1. An exercise brassiere comprising:

an elastic outer fabric layer;

an inner fabric layer for contacting the skin of a wearer two breast cups discrete from and disposed between said inner and outer fabric layers, each of said breast cups being positioned to substantially cover one of the wearer's breasts, each of said breast cups including a lower and outer side guadrant area positioned to cover the lower and outer side quadrant area of the wearer's breast, each of said breast cups further including a support member positioned adjacent said inner fabric layer, each of said support members being positioned solely within said lower and outer side quadrant area of said corresponding breast cup over the lower and outer side quadrant area of the wearer's breast, wherein said support members together maintain upward and inward pressure on the wearer's breasts to push the wearer's breasts upwardly and toward each other; and an elastic band disposed about the lower edges of said inner fabric layer and said outer fabric layer to limit the transverse movement of said breast cups.

2. The exercise brassiere described in claim 1, wherein each said support member comprises a breast pad.

3. The exercise brassiere described in claim 2, wherein each said support member further comprises an underwire positioned along a lower periphery of said respective breast pad.

4. The exercise brassiere described in claim 1, wherein said elastic band comprises a width dimension of at least 3 centimeters.

5. The exercise brassiere described in claim 1, wherein said breast cups are positionally fixed between said outer fabric layer and said inner fabric layer.

6. The exercise brassiere described in claim 1, wherein said outer fabric layer is constructed substantially without seams.

7. The exercise brassiere described in claim 5, wherein said support members are oval-shaped breast pads.

8. An exercise brassiere comprising:

an elastic outer fabric layer;

an inner fabric layer for contacting the skin of a wearer;

two breast cups discrete from and disposed between said inner and outer fabric layers, said breast cups each being sized, configured and positioned to substantially cover one of the wearer's breasts, said breast cups each including a lower and outer side quadrant area positioned to cover the lower and outer side quadrant area of the respective breast and an upper and inner side quadrant area positioned to cover the upper and inner side quadrant area of the respective breast, said breast cups each further including a support member adjacent said inner fabric layer, each of said support members being positioned substantially within said lower and outer side quadrant area of said corresponding breast cup, wherein the thickness of each of said breast cups in the area of said support members is greater than the thickness at said upper and inner portion side quadrant areas, whereby said support members together maintain upward and inward pressure on the wearer's breasts to push the wearer's breasts upwardly and toward each other; and an elastic band disposed about the lower edges of said inner fabric layer and said outer fabric layer to limit the transverse movement of said breast cups.

9. The exercise brassiere described in claim 8, wherein said support members are oval-shaped breast pads.

10. The exercise brassiere described in claim 9, wherein each said support member further comprises an underwire positioned along a lower periphery of said respective breast pad.

11. The exercise brassiere described in claim 8, wherein said breast cups are positionally fixed between said outer fabric layer and said inner fabric layer.

12. The exercise brassiere described in claim 11, wherein said elastic band comprises a width dimension of at least 3 centimeters.

13. The exercise brassiere described in claim 12, wherein said outer fabric layer is constructed substantially without seams.

* * * * *